US010789898B2

(12) United States Patent
Chen

(10) Patent No.: US 10,789,898 B2
(45) Date of Patent: Sep. 29, 2020

(54) DISPLAY METHOD WITH VOLTAGE SIGNAL CONVERSION BASED ON LOOKUP TABLE AND DISPLAY DEVICE

(71) Applicants: HKC Corporation Limited, Shenzhen (CN); Chongqing HKC Optoelectronics Technology Co., ltd., Chongqing (CN)

(72) Inventor: Yu-Jen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 159 days.

(21) Appl. No.: 15/858,423

(22) Filed: Dec. 29, 2017

(65) Prior Publication Data

US 2019/0043433 A1 Feb. 7, 2019

Related U.S. Application Data

(63) Continuation of application No. PCT/CN2017/107253, filed on Oct. 23, 2017.

(30) Foreign Application Priority Data

Aug. 1, 2017 (CN) ..... 2017 1 0647288

(51) Int. Cl.
*G09G 3/30* (2006.01)
*G09G 3/36* (2006.01)

(52) U.S. Cl.
CPC ..... *G09G 3/3607* (2013.01); *G09G 3/36* (2013.01); *G09G 2320/028* (2013.01); *G09G 2320/0242* (2013.01); *G09G 2320/0295* (2013.01); *G09G 2320/0673* (2013.01); *G09G 2360/16* (2013.01)

(58) Field of Classification Search
CPC ..... G09G 2310/0264–0297; G09G 2320/0276
See application file for complete search history.

(56) References Cited

U.S. PATENT DOCUMENTS 5,194,136 A * 3/1993 Jeung ..... G02F 1/1362 205/122
2015/0009188 A1* 1/2015 Choi ..... G09G 3/20 345/204
2017/0193874 A1* 7/2017 Laurion ..... B24D 11/001

* cited by examiner

*Primary Examiner* — Sanghyuk Park
(74) *Attorney, Agent, or Firm* — WPAT, PC

(57) ABSTRACT

The present embodiment provides a display method and a display device, wherein the display method includes: receiving an image data of a target picture; acquiring a first voltage signal corresponding to the image data; converting the adjacent first voltage signal into a voltage distributed second voltage signal; driving a pixel unit and responding the pixel unit to display the target picture according to the second voltage signal.

14 Claims, 10 Drawing Sheets

DISPLAY METHOD WITH VOLTAGE SIGNAL CONVERSION BASED ON LOOKUP TABLE AND DISPLAY DEVICE

FIELD OF THE DISCLOSURE

The present disclosure relates to an electronic technology field, and more particularly to a display method and a display device.

BACKGROUND OF THE DISCLOSURE

Most of the current large-size LCD panel used is the negative vertical alignment (VA) LCD or the in-plane switching (IPS) LCD technology. The VA-type LCD technology compared to the IPS liquid crystal technology has advantages of high production efficiency and low manufacturing cost. However, the VA-type liquid crystal technology in the optical properties compared to the IPS liquid crystal technology are more obvious optical defects, especially large-size panel in the commercial application needs a larger perspective. The VA-type LCD driver in the viewing angle color is often unable to meet the market demand.

The method of the general VA-type LCD technology to solve the viewing angle color shift is subdividing the RGB sub-pixel into primary and secondary pixels and giving the different driving voltages to the primary and secondary pixels on the space to solve the defects of the viewing angle color shift. This often requires the design of metal traces or thin film transistor (TFT) components to drive sub-pixels, resulting in the sacrifice of the transparent open area, the impact of the panel penetration, and the promotion of the backlight cost.

SUMMARY OF THE DISCLOSURE

The embodiment of the present application provides a display method and a display device which can improve the panel's luminous flux, reduce the backlight cost and improve the color shift phenomenon.

In one aspect, the present application provides a display method including:

receiving an image data of a target picture;

acquiring a first voltage signal corresponding to the image data;

converting the adjacent first voltage signal into a voltage distributed second voltage signal;

driving a pixel unit and responding the pixel unit to display the target picture according to the second voltage signal.

In another aspect, the present application provides a display method including:

receiving an image data of a target picture;

acquiring a first voltage signal corresponding to the image data;

converting the adjacent first voltage signal into a voltage distributed second voltage signal;

determining whether the second voltage signal exceeds a preset voltage threshold; deleting a duration corresponding to the second voltage signal according to a preset deletion ratio if the second voltage signal exceeds the preset voltage threshold;

driving a pixel unit and responding the pixel unit to display the target picture according to the second voltage signal, wherein a surface of the pixel unit is etched with a first alignment pattern and a second alignment pattern, the first alignment pattern being stacked in parallel with the second alignment pattern and shifting a preset distance;

wherein the first voltage signal includes a voltage signal corresponding to a red, green, and blue sub-pixel unit of the pixel unit, converting a voltage signal group corresponding to a plurality of the blue or green or red sub-pixel units into a voltage signal group with voltage distributed, the voltage distributed voltage signal group is the second voltage signal, wherein the number of the blue sub-pixel units for converting each of the second voltage signals is greater than the number of the green or red sub-pixel units for converting to each of the second voltage signals.

In yet another aspect, the present application provides a display device including:

a display panel;

a receiving unit for receiving image data of the target picture;

an acquisition unit for acquiring a first voltage signal corresponding to the image data;

a conversion unit for converting the adjacent first voltage signal into a voltage distributed second voltage signal;

and an execution unit for driving a pixel unit and responding the pixel unit to display the target picture according to the second voltage signal.

The display method and the display device of the embodiment of the present application converting the first voltage signal into a voltage distributed second voltage signal after acquiring the first voltage signal corresponding to the image data. And then driving the pixel unit and responding the pixel unit to display the target picture according to the second voltage signal. So that the voltage distributed voltage signal on the adjacent space achieves the brightness of the face view and side view closing to the target. Thereby improving the chromatic aberration phenomenon, improving the panel permeability, and reducing the cost of the backlight.

BRIEF DESCRIPTION OF THE DRAWINGS

In order to more clearly illustrate the technical solution of the embodiment of the present application, the drawings to be used in the description of the examples will be briefly described below. It will be apparent that the drawings in the following description are some embodiments of the present application, and other drawings may be obtained by those skilled in the art without departing from the inventive work.

DETAILED DESCRIPTION OF PREFERRED EMBODIMENTS

The technical solution in the embodiments of the present application will be described in detail below in connection with the drawings in the embodiments of the present application. It is obvious that the described embodiments are part of the present application, not all embodiments. All other embodiments obtained by those of ordinary skill in the art without making creative work are within the scope of this application, based on the embodiments of the present application.

It is to be understood that the terms "including" and "comprising" indicate the presence of the described features, integers, steps, operations, elements and/or components when used in this specification and in the appended claims. But does not preclude the presence or addition of one or more other features, integers, steps, operations, elements, components and/or collections thereof.

Figure 1:
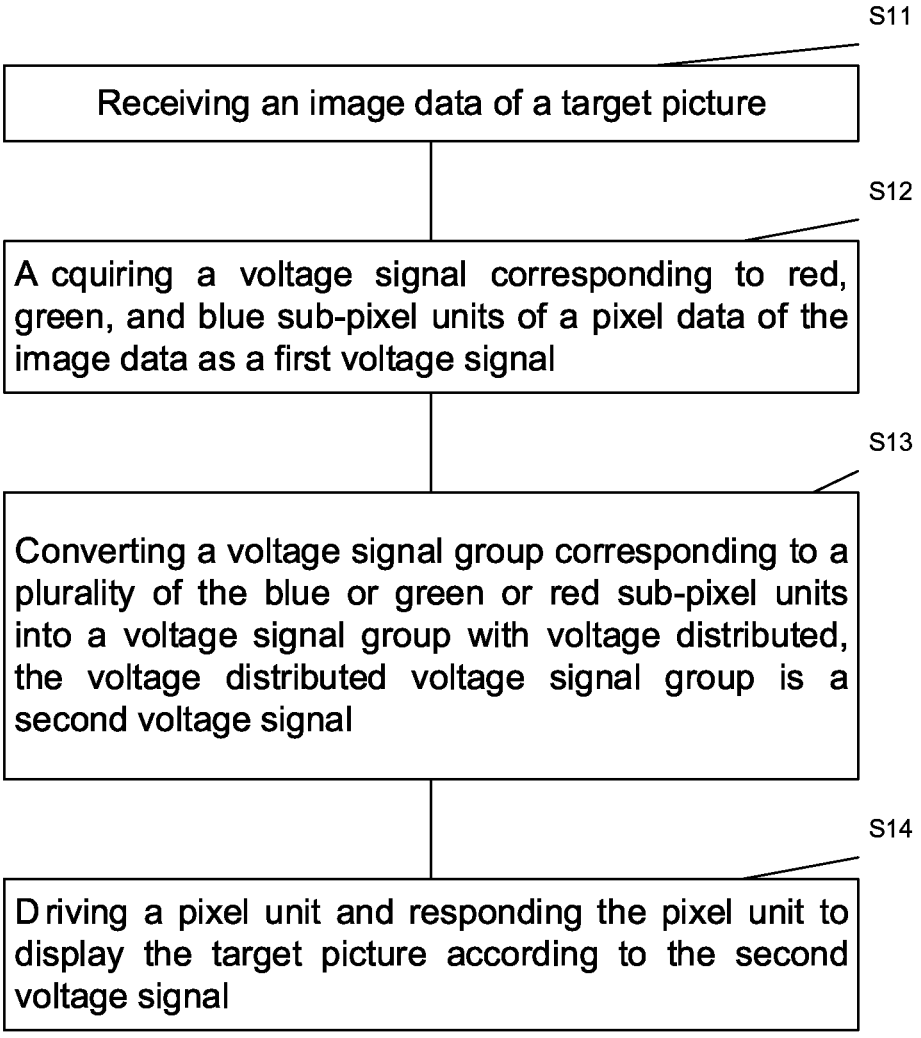
FIG. 1 is a schematic flow diagram of a display method provided in the first embodiment of the present application.

Referring to FIG. 1, which is a schematic flow diagram of a display method provided in the first embodiment of the present application, the method includes the following steps S11 to S14:

Step S11: receiving an image data of a target picture.

Specifically, the receiving an image data of a target picture is the screen driving panel of the display device receiving the image data of the screen to be displayed sent by the front end. Since the display device is a frame-by-frame display, the screen driving panel receiving the front-end data is also frame-by-frame. Wherein 1 to 2 frame image data are stored in the memory of the screen driving panel to facilitate the control IC of the screen driving panel analyzing the 1 to 2 frame image data, in order to perform the subsequent steps.

Step S12: acquiring a voltage signal corresponding to red, green, and blue sub-pixel units of a pixel data of the image data as a first voltage signal.

Specifically, the voltage signal corresponding to the red, green, and blue sub-pixel units of the pixel unit is obtained as the first voltage signal. That is, a voltage signal for displaying the target picture corresponding to each of the red, green and blue sub-pixel units is obtained, and the voltage signal is converted as a first voltage signal for subsequent steps.

Step S13: converting a voltage signal group corresponding to a plurality of the blue or green or red sub-pixel units into a voltage signal group with voltage distributed, the voltage distributed voltage signal group is a second voltage signal.

Figure 6:
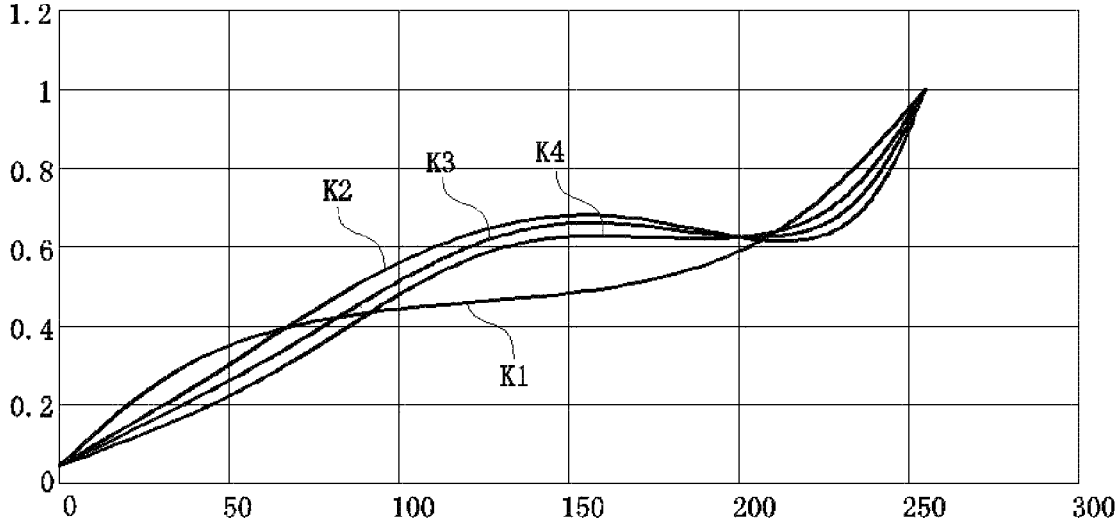
FIG. 6 is a graph showing the relationship between the luminance and the voltage of the display method provided in the embodiment of the present application.
Figure 7:
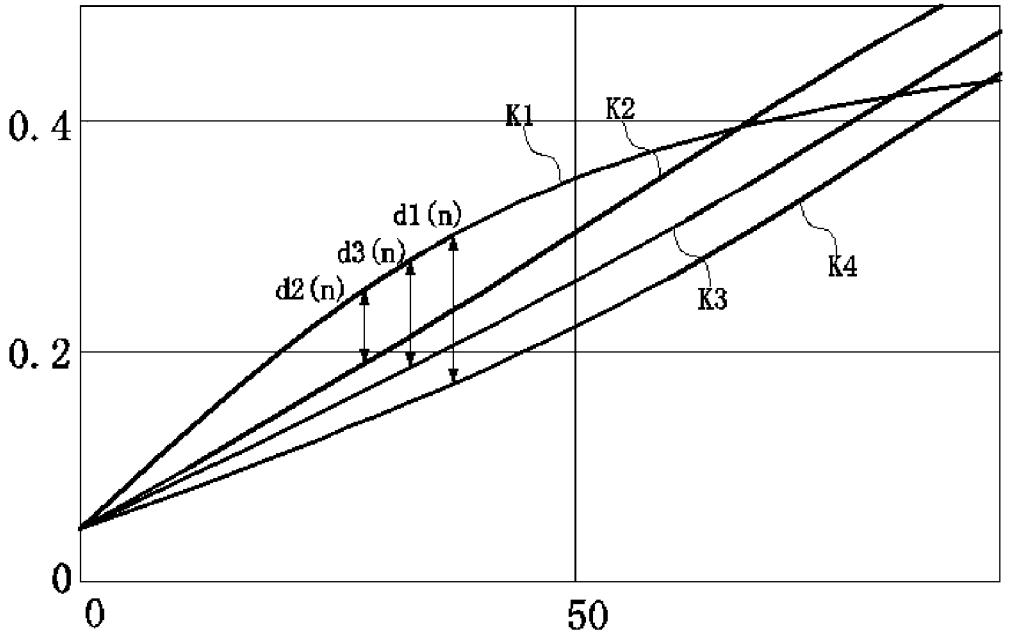
FIG. 7 is a partial relationship between the luminance and the voltage of the display method provided in the embodiment of the present application.
Figure 8:
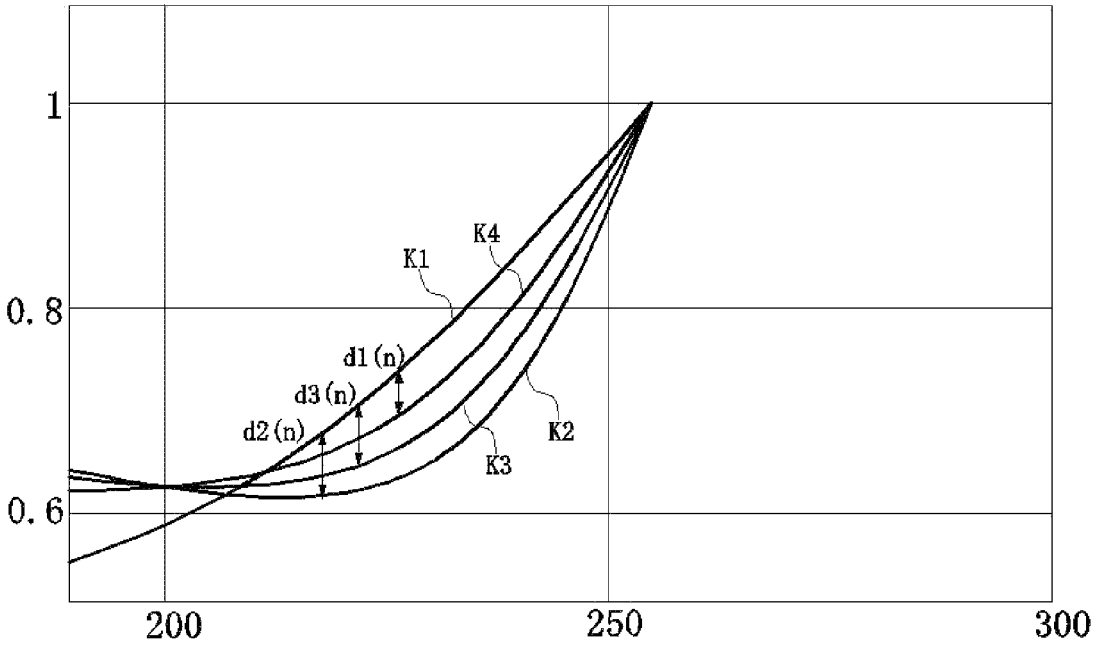
FIG. 8 is another partial relationship diagram of the luminance and voltage of the display method provided in the embodiment of the present application.

Specifically, referring to FIGS. 6 to 8, which is a curve of voltage (horizontal axis) increase and luminance (vertical axis) variation, K1 is the target voltage increase with the brightness change curve when looking at the front. Through the distribution of high and low voltage signals (That is, high and low voltage signal interval distribution, the adjacent two voltage signals for a high and one low) to meet the closing proportion of the brightness changes of the face and side view. As shown in FIG. 6, Curve K2 and K4 are the situation of side view brightness changes with voltage in two high voltage and low voltage combination. As shown in FIGS. 7 and 8, for the local high voltage and low voltage curve in different combinations of design can be found with the target curve K1 will have different degrees of difference. A voltage distributed voltage cannot meet the need of the high and low voltage brightness closing to the target brightness.

As shown in FIG. 7, when considering the relationship between low voltage and brightness change, the difference d1($n$) between the actual brightness and the target luminance in the voltage distributed voltage combination K4 is greater than the difference d2($n$) between the actual brightness and the target luminance in the space segmented high and low voltage combination K2. As shown in FIG. 8, when considering the relationship between high voltage and brightness change, the difference d1($n$) between the actual brightness and the target luminance in the voltage distributed voltage combination K4 is far less than the voltage distributed voltage combination K2. The space segmented high and low voltage combination K4 is suitable when the quality content of the display appears a higher voltage signal. On the other hand, the space segmented high and low voltage combination K2 is suitable when the quality content of the display appears a lower voltage signal. The curve of viewing angle and brightness K3 is generated by the high and low voltage combination of K4 and K2. Its characteristic combines the advantages of K4 high gray scale combination and K2 low gray scale combination, so that the angle curve is closer to the target curve, the curve changes are smoother, and it is not easy to have the phenomenon of color quality mutation or abnormal color mixing.

Figure 3:
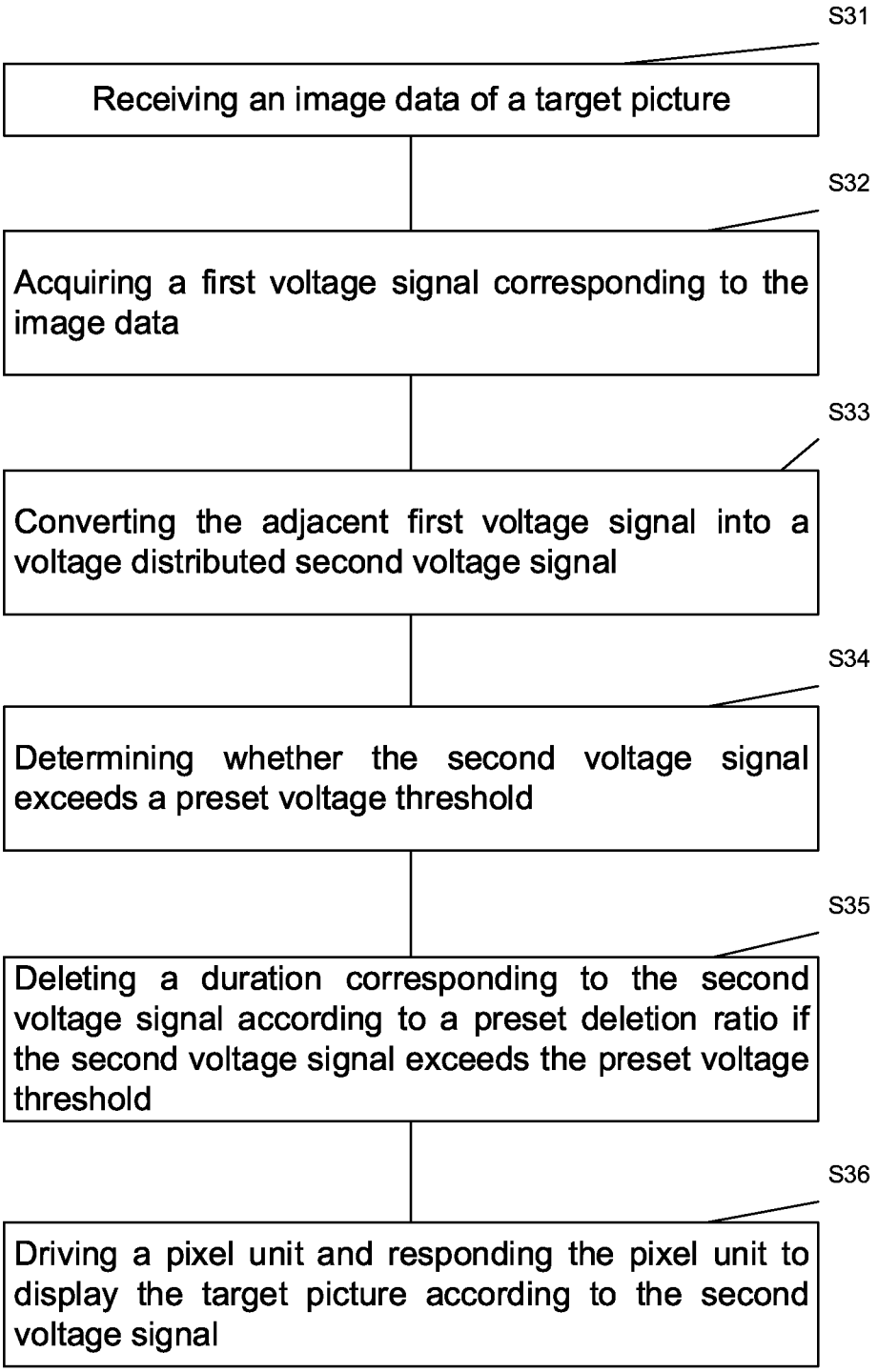
FIG. 3 is a schematic flow diagram of a display method provided in the third embodiment of the present application.

Specifically, in the case of an RGB three-color display device, each pixel unit corresponds to a sub-pixel unit having red, green, and blue (RGB) three primary colors. Corresponding image voltage signals are denoted as Ri, j, Gi, j, Bi, j (i, j=1, 2, 3 . . . ). In the following, the voltage signal of the blue sub-pixel unit is taken as an example, and four voltage signals of Bi, j and adjacent Bi, j+1, Bi+1, j, Bi+1, j+1. The four voltage signals are converted into Bn'_H1, Bn'_H2 high voltage signals and Bn'_L1, Bn'_L2 low voltage signals. Wherein the voltage combination of Bn'_H1 and Bn'_L1 is the curve K4 as shown in FIG. 6, the other voltage combination of Bn'_H2 and Bn'_L2 is the curve K2 as shown in FIG. 3. In this application, Bn'_1, Bn'_H2, Bn'_L1, Bn'_L2 are substituted for the picture quality signals of the original four blue sub-pixel units Bi, j, Bi, j+1, Bi+1, j, Bi+1, j+1, so that the angle view of the K3 curve shown in FIG. 6 compared to the original K4, K2 curve in the high and low gray scale can be closer to the target viewing angle curve K1 to solve a set of voltage cannot solve the high and low voltage can simultaneously meet the shortcomings of viewing angle compensation.

Figure 4:
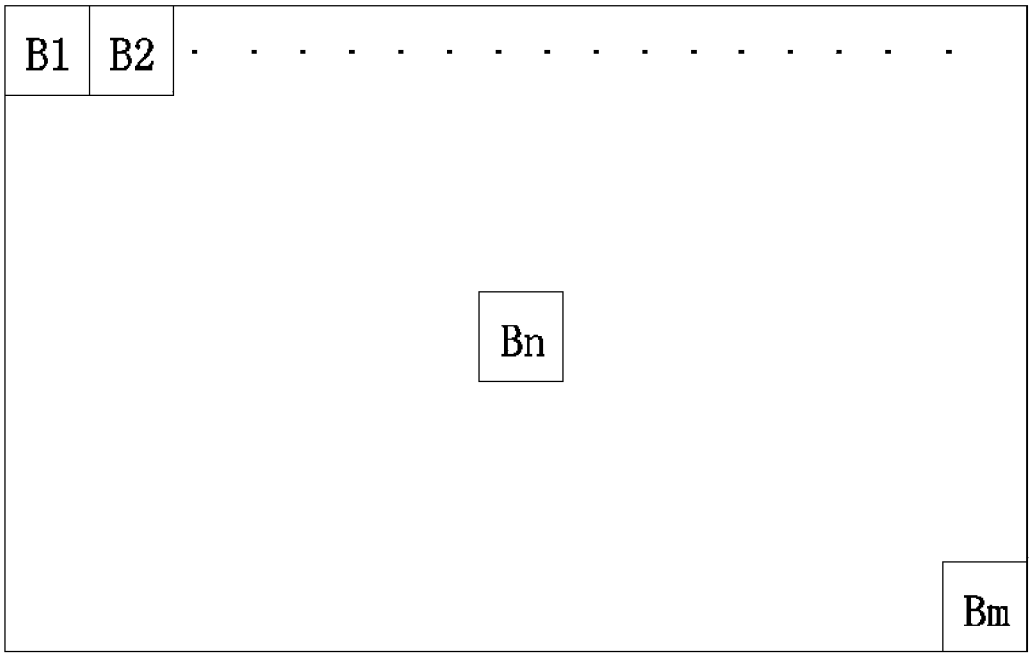
FIG. 4 is a schematic diagram of a display area block distribution of a display method provided in the embodiment of the present application.
Figure 5:
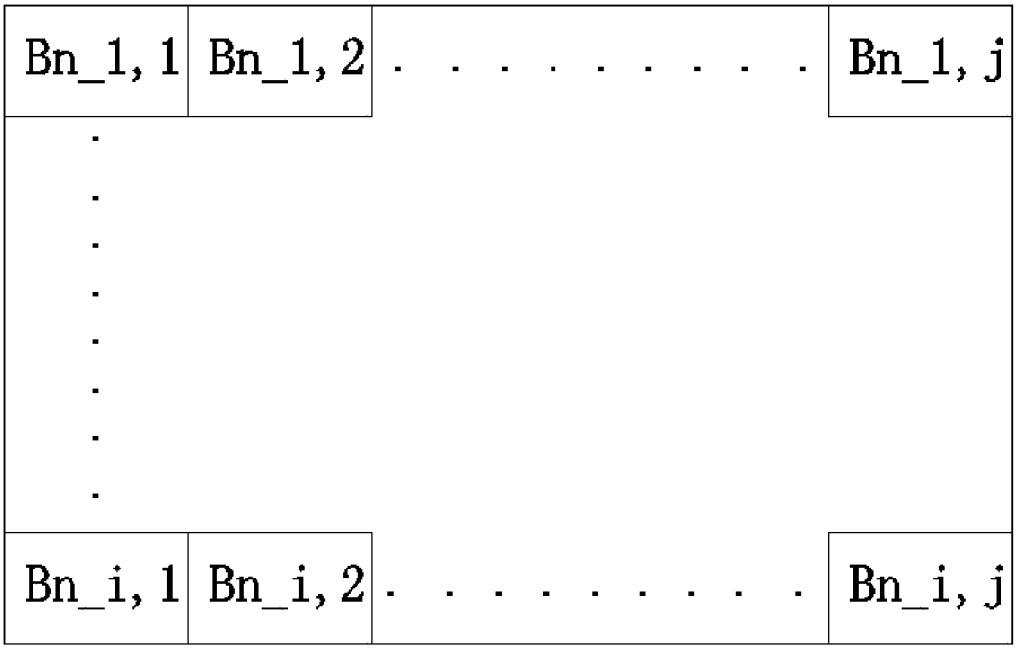
FIG. 5 is a schematic representation of the display area pixel unit distribution of the display method provided by the embodiment of the present application.

Referring to FIGS. 4 and 5, the original image of the full-frame blue picture quality is divided into a plurality of blocks n=0, 1, 2, . . . , M in the RGB three-color display device as an example, as shown in FIG. 4, respectively, B1, B2, B3, . . . , BM. As shown in FIG. 5, each of the divided blocks n contains a plurality of blue sub-pixels, and the blue sub-pixels are arranged as Bn_1,1, Bn_1,2, . . . Bn_i, j. Bn'=Average (Bn_1,1, Bn_1,2, . . . Bn_2,1, Bn_2,2 , . . . , Bn_i, j) for all blue sub-pixel signals in the n block.

Similarly, when the whole picture is green, the average value of all green sub-pixel signal in the block n is Gn'=Average(Gn_1,1, Gn_1,2, . . . Gn_2,1, Gn_2,2 . . . , Gn_i,j). When the whole picture is red, the average value of all red sub-pixel signal in the block n is Rn'=Average(Rn_1,1, Rn_1,2, . . . Rn_2,1, Rn_2,2 . . . , Rn_i,j).

Figure 9:
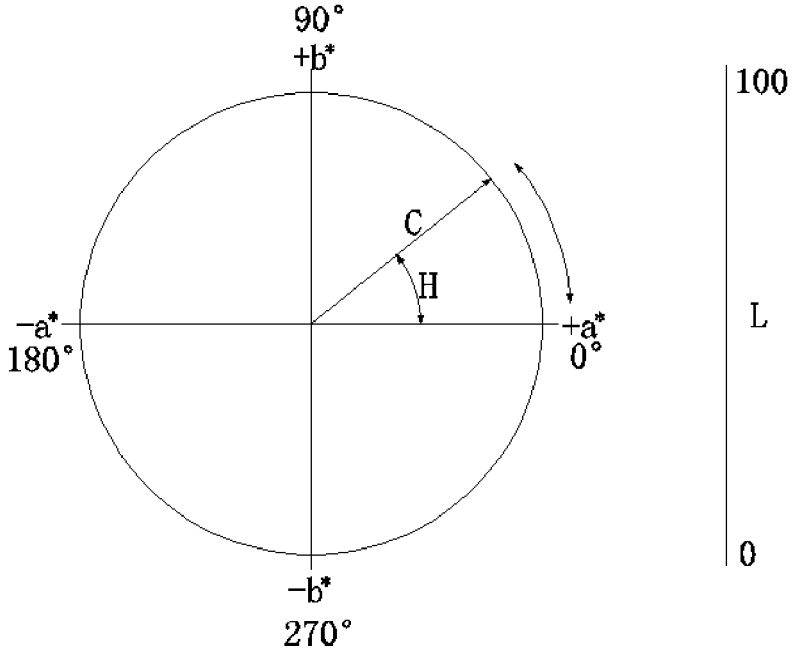
FIG. 9 is a color space diagram of the Lab and LCH of the display method provided in the embodiments of the present application.

The embodiment of the present application judges the combination of the high and low voltage signals of the RGB sub-pixel unit by color. Referring to the CIE LCH color space diagram shown in FIG. 9, the color of the combined pixels representing the RGB in the color coordinate system is represented by L (luminance), C (saturation), and H (hue). Where H is 0° to 360° for different hue colors, 0° is defined as red, 90° is yellow, 180° is green, 270° is blue, C is color saturation, which represents the brightness of color, C range is expressed as 0 to 100,100 on behalf of the most vivid colors, C values to a certain extent, reflects the LCD display voltage signal level.

Figure 12:
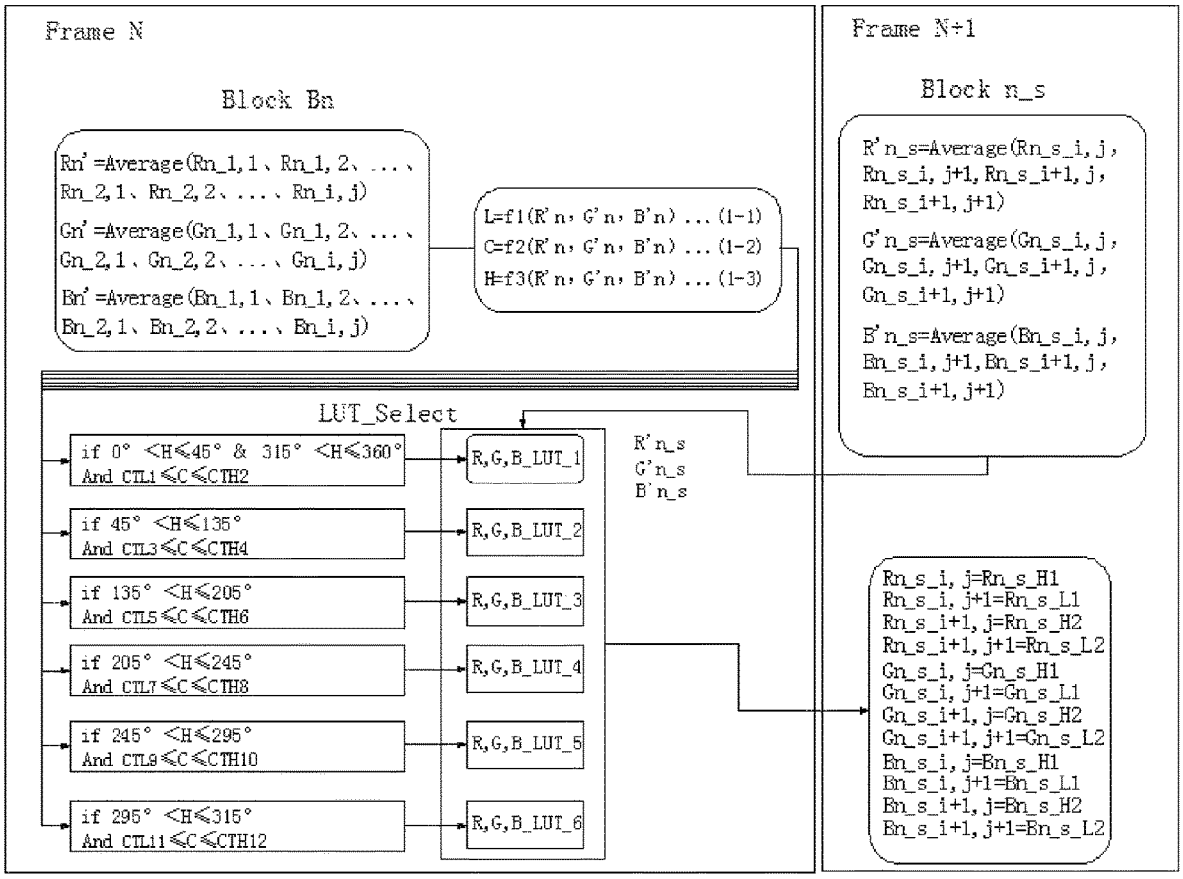
FIG. 12 is a flow chart of the replacement of the voltage signal provided in the first embodiment of the present disclosure.

The first voltage signal corresponding to the RGB sub-pixel unit is converted according to the specific case in FIG. 12 to obtain a corresponding second voltage signal:

(1) the hue of the combination pixel calculated by the average signals Bn', Rn' and Gn' satisfied 0°<H≤45° and 315°<H≤360°, and the judgment criteria of the color saturation satisfied the CTL1≤C≤CTH2 is using the high and low voltage combination R_LUT_1, G_LUT_1 and B_LUT_1.

(2) the hue of the combination pixel calculated by the average signals Bn', Rn' and Gn' satisfied 45°<H≤135°, and the judgment criteria of the color saturation satisfied the CTL3≤C≤CTH4 is using the high and low voltage combination R_LUT_2, G_LUT_2 and B_LUT_2.

(3) the hue of the combination pixel calculated by the average signals Bn', Rn' and Gn' satisfied 135°<H≤205°, and the judgment criteria of the color saturation satisfied the CTL5≤C≤CTH6 is using the high and low voltage combination R_LUT_3, G_LUT_3 and B_LUT_3.

(4) the hue of the combination pixel calculated by the average signals Bn', Rn' and Gn' satisfied 205°<H≤245°, and the judgment criteria of the color saturation satisfied the CTL7≤C≤CTH8 is using the high and low voltage combination R_LUT_4, G_LUT_4 and B_LUT_4.

(5) the hue of the combination pixel calculated by the average signals Bn', Rn' and Gn' satisfied 245°<H≤295°, and the judgment criteria of the color saturation satisfied the CTL9≤C≤CTH10 is using the high and low voltage combination R_LUT_5, G_LUT_5 and B_LUT_5.

(6) the hue of the combination pixel calculated by the average signals Bn', Rn' and Gn' satisfied 295°<H≤315°, and the judgment criteria of the color saturation satisfied the CTL11≤C≤CTH12 is using the high and low voltage combination R_LUT_6, G_LUT_6 and B_LUT_6.

Each of the average signals Bn', Rn' and Gn' corresponds to the search value of the fixed R/G/B pixels Rn_s_i,j, Rn_s_i,j+1, Rn_s_i+1,j, Rn_s_i+1,j+1/Gn_s_i,j, Gn_s_i,j+1, Gn_s_ i+1,j, Gn_s_i+1,j+1/Bn_s_i,j, Bn_s_i,j+1, Bn_s_i+1,j, Bn_s_i+1,j+1 of the two sets of high and low voltage combinations Rn_s_ H1, Rn_s_L1, Rn_s_H2, Rn_s_L2/Gn_s_H1, Gn_s_L1, Gn_s_H2, Gn_s_L2/Bn_s_H1, Bn_s_L1, Bn_s_H2, Bn_s_L2, which can make the angle curve closer to the target curve.

Example of a blue sub-pixel cell signal in which four adjacent sub-pixels are labeled as four signals Bn_s_i, j, Bn_s_i, j+1, Bn_s_i+1, j, Bn_s_i+1, j+1, averaging the signal B'n_s=Average (Bn_s_i, j, Bn_s_i, j+1, Bn_s_i+1, j, Bn_s_i+1, j+1), s represents the number of cell blocks in the n block that are combined with four blue sub-pixel units. The new blue sub-pixel signal in the cell block is obtained by taking the average signal B'n_s of the four blue sub-pixel signal in the cell block, by taking the average signal Bn' of all the blue sub-pixel unit signals Bn_i,j in the n block (frame N), and by the lookup table of the color judgment condition. FIG. 12 shows the two sets of high and low voltage combinations Bn_s_H1, Bn_s_L1 and Bn_s_H2, Bn_s_L2 for each group of cell block signal mean values B'n_s. The two high and low voltage combinations Bn_s_H1, Bn_s_L1 and Bn_s_H2, Bn_s_L 2 signals correspond to FrameN+1 frame, that is, the high and low voltage signals of the four blue sub-pixel units corresponding to the new cell block signal is Bn_s_i, j=Bn_s_H1, Bn_s_i, j+1=Bn_s_L1, Bn_s_i+1, j=Bn_s_L2, Bn_s_i+1, j+1=Bn_s_H2.

Step S14: driving a pixel unit and responding the pixel unit to display the target picture according to the second voltage signal.

Specifically, driving the RGB sub-pixel unit of the pixel unit and responding the pixel unit to display the target picture by the converted voltage distributed second voltage signal.

Specifically, after the first voltage signal corresponding to the acquired image data is obtained, the first voltage signal is converted into a second voltage signal having a voltage high and low phase distribution. And then the display device drives the pixel unit and responses the second voltage signal to display the target screen, so that the high and low voltage signals distributed in the adjacent space are close to the target which is close to the face view and side view brightness change, thereby improving the chromatic aberration phenomenon. Since the second voltage signal is responded by each individual sub-pixel unit, it is not necessary to divide the primary and secondary pixels on the RGB sub-pixel unit, thus the reduction of the translucent opening area caused by the need to re-design the metal traces or TFT components to drive the secondary pixels is avoided, thereby increasing the panel permeability and reducing the backlight cost.

Figure 2:
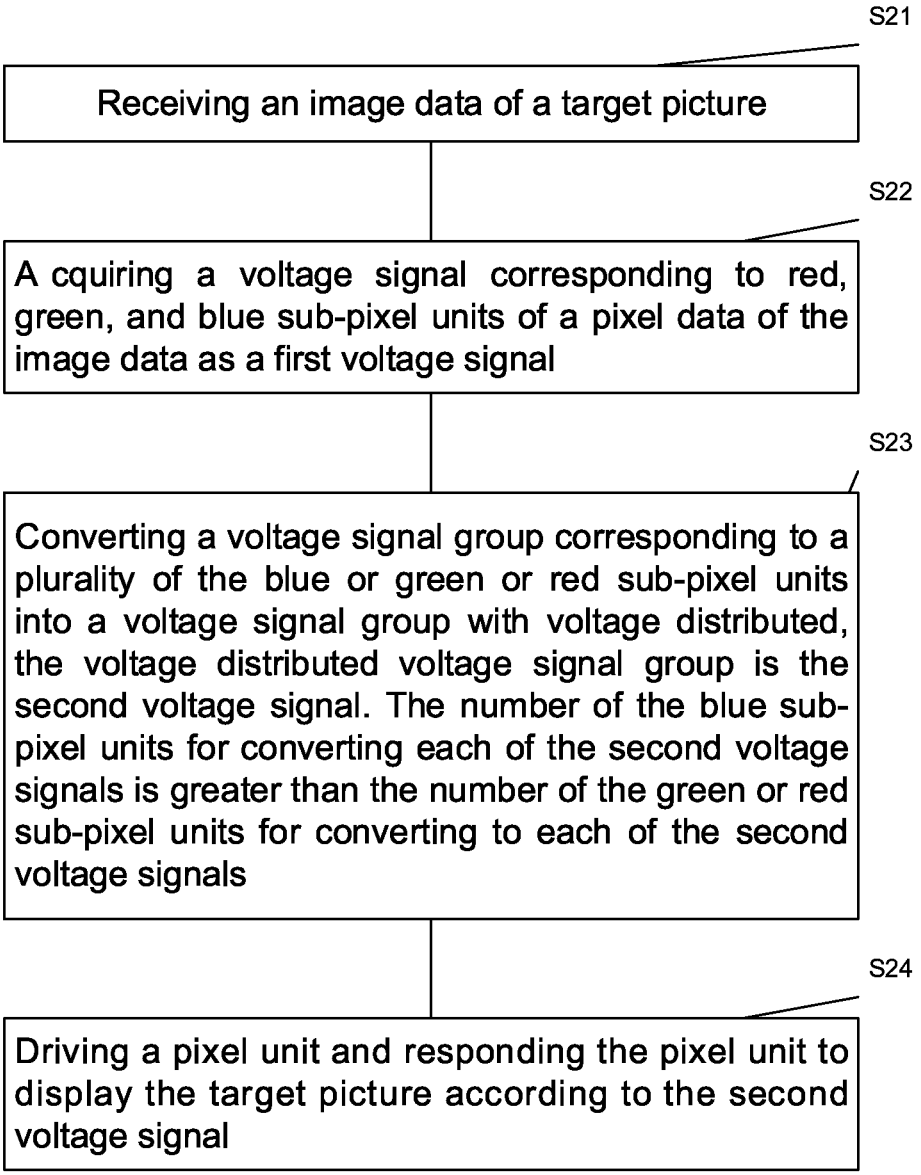
FIG. 2 is a schematic flow diagram of a display method provided in the second embodiment of the present application.

Referring to FIG. 2, FIG. 2 is a schematic flow diagram of a display method provided in the second embodiment of the present application. As shown in FIG. 2, the method includes the following steps S21 to S24:

Step S21: receiving an image data of a target picture.

Specifically, the receiving an image data of a target picture is the screen driving panel of the display device receiving the image data of the screen to be displayed sent by the front end. Since the display device is a frame-by-frame display, the screen driving panel receiving the front-end data is also frame-by-frame. Wherein 1 to 2 frame image data are stored in the memory of the screen driving panel to facilitate the control IC of the screen driving panel analyzing the 1 to 2 frame image data, in order to perform the subsequent steps.

Step S22: acquiring a voltage signal corresponding to red, green, and blue sub-pixel units of a pixel data of the image data as a first voltage signal.

Specifically, the voltage signal corresponding to the red, green, and blue sub-pixel units of the pixel unit is obtained as the first voltage signal. That is, a voltage signal for displaying the target picture corresponding to each of the red, green and blue sub-pixel units is obtained, and the voltage signal is converted as a first voltage signal for subsequent steps.

Step S23: converting a voltage signal group corresponding to a plurality of the blue or green or red sub-pixel units into a voltage signal group with voltage distributed, the voltage distributed voltage signal group is the second voltage signal. The number of the blue sub-pixel units for converting each of the second voltage signals is greater than the number of the green or red sub-pixel units for converting to each of the second voltage signals.

Specifically, red and green are used as sub-pixel units less than blue (e.g., red and green 2, blue 4) to convert as a set of high and low voltage signals, that is, a green or red sub-pixel unit smaller than the blue sub-pixel unit is converted as a group. In each of the individual high and low voltage signal groups after conversion, the green or red sub-pixel unit is less than the blue sub-pixel unit in each individual high and low voltage signal group.

Figure 13:
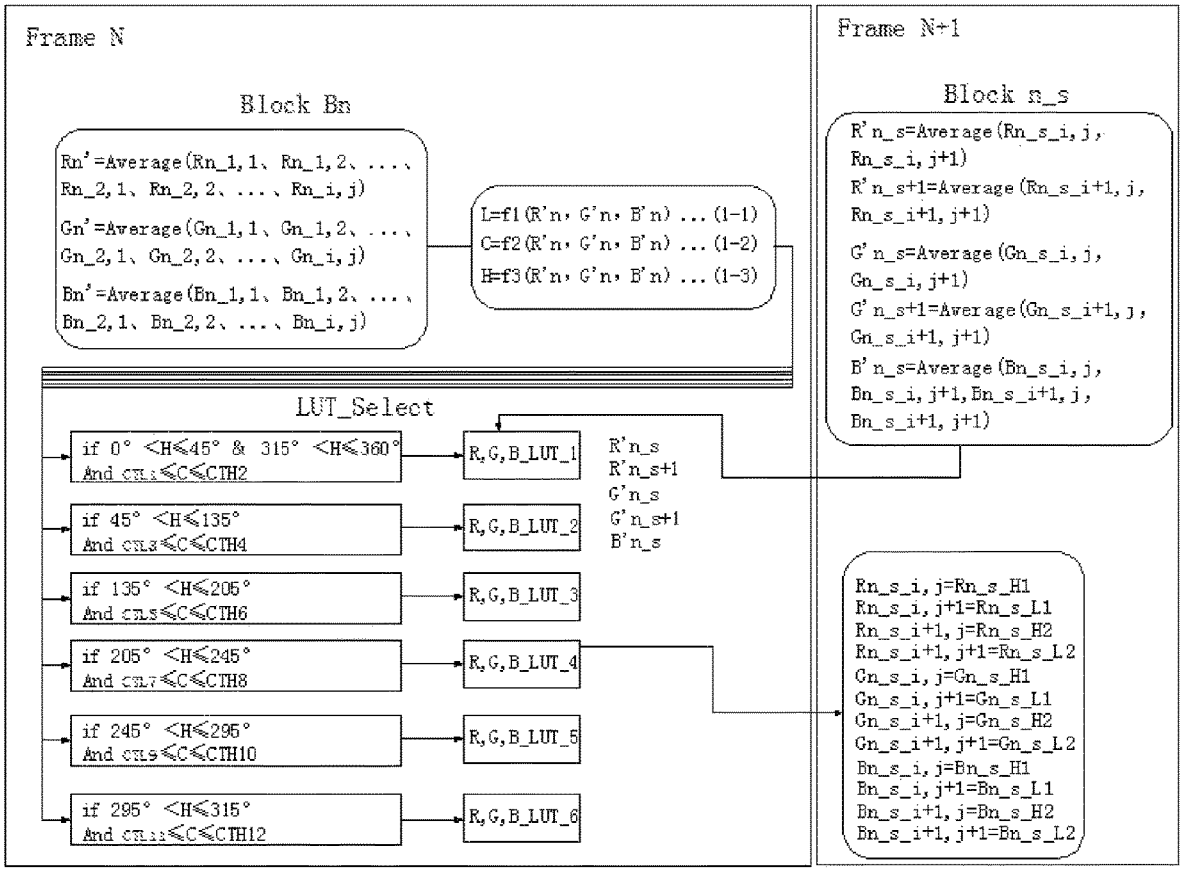
FIG. 13 is a flow chart of the replacement of the voltage signal provided in the second embodiment of the present disclosure.

The first voltage signal corresponding to the green and red sub-pixel units is converted according to the specific situation in FIG. 13 to obtain a corresponding second voltage signal.

Example Red pixel signal, in the n block, the adjacent four sub-pixel signals Rn_s_i, j, Rn_s_i, j+1, Rn_s_i+1, j, Rn_s_i+1, j+1 take the average signal:

R'n_s=Average(Rn_s_i,j,Rn_s_i,j+1),R'n_s+1=Average (Rn_s_i+1,j,Rn_s_i+1,j+1).

s represents the number of cell blocks in the block that are combined with four red sub-pixels. S, S+1 is the four red sub-pixels for the combination of the block number and then divided into two independent combination of high and low voltage signal pairs. Each of the new red sub-pixel signals is subdivided into two independent sub-pixel signal averages R'n_s, R'n_s+1 by the four sub-pixel blocks. The average signal Bn' is calculated based on the signal Bn_i, j of all the blue sub-pixel units in the n block (Frame N). The four red sub-pixel units in the new cell block signal is corresponding outputted by the lookup table of the color judgment condition. As shown in FIG. 13: Rn_s_i, j=Rn_s_H1, Rn_s_i, j+1=Rn_s_L1, Rn_s_i+1, j=Rn_s_L2, Rn_s_i+1, j+1=Rn_s_H2.

The conversion mode of the green sub-pixel unit is the same as that of the red sub-pixel unit in the present embodiment, and the blue sub-pixel unit is converted in the same manner as in the first embodiment.

Step S24: driving a pixel unit and responding the pixel unit to display the target picture according to the second voltage signal.

Specifically, driving the RGB sub-pixel unit of the pixel unit and responding the pixel unit to display the target picture by the converted voltage distributed second voltage signal.

Specifically, because the human eye feels green and red is more sensitive. Since the number of blue sub-pixel units converted to each second voltage signal is larger than the number of green or red sub-pixel units for converting to the second voltage signal. So that the resolution of the converted green and red second voltage signals will be higher than the resolution of the blue second voltage signal, thereby avoiding the graininess of the picture.

Referring to FIG. 3, FIG. 3 is a schematic flow diagram of a display method provided in the third embodiment of the present application. As shown in FIG. 3, the method includes the following steps S31 to S36:

Step S31: receiving an image data of a target picture.

Specifically, the receiving an image data of a target picture is the screen driving panel of the display device receiving the image data of the screen to be displayed sent by the front end. Since the display device is a frame-by-frame display, the screen driving panel receiving the front-end data is also frame-by-frame. Wherein 1 to 2 frame image data is stored in the memory of the screen driving panel to facilitate the control IC of the screen driving panel analyzing the 1 to 2 frame image data, in order to perform the subsequent steps.

Step S32: acquiring a first voltage signal corresponding to the image data.

Specifically, the first voltage signal corresponding to the image data is obtained, that is, the voltage signal for displaying the target picture corresponding to each pixel unit is acquired.

Step S33: converting the adjacent first voltage signal into a voltage distributed second voltage signal.

Specifically, the adjacent first voltage signal is converted into a voltage signal with voltage distributed, and the specific conversion mode is described in the first or second embodiment.

Step S34: determining whether the second voltage signal exceeds a preset voltage threshold.

Specifically, the magnitude of the voltage corresponding to the second voltage signal is compared with the magnitude of the preset voltage threshold to determine whether the voltage magnitude corresponding to the second voltage signal is greater than the preset voltage threshold.

Step S35: deleting a duration corresponding to the second voltage signal according to a preset deletion ratio if the second voltage signal exceeds the preset voltage threshold.

Specifically, if the voltage magnitude corresponding to the second voltage signal exceeds the preset voltage threshold value, the duration of the second voltage signal exceeding the preset voltage threshold is subtracted according to the preset deletion ratio. For example, the default deletion ratio is 20%, the duration of the second voltage signal exceeding the preset voltage threshold is 100 ms, then the original 100 ms minus 20 ms according to the deletion ratio of 20%, eventually the duration corresponding to the second voltage signal exceeding the preset voltage threshold is 80 ms.

Step S36: driving a pixel unit and responding the pixel unit to display the target picture according to the second voltage signal.

Specifically, driving the RGB sub-pixel unit of the pixel unit and responding the pixel unit to display the target picture by the converted voltage distributed second voltage signal.

In particular, by reducing the time of the second voltage signal exceeding the preset voltage threshold, the interference of the residual image left after the long display of the high luminance picture corresponding to the high voltage signal to the next frame is avoided, and the screen display clarity is improved.

Further, a surface of the pixel unit is etched with a first alignment pattern and a second alignment pattern in which the first alignment pattern and the second alignment pattern are stacked in parallel and shifted from the preset distance.

Specifically, the first alignment pattern and the second alignment pattern of the pixel unit surface etched is composed by the electrode slits. At present, the resolution of the exposure machine and the process capability of the etching process capability are limited. Assuming that the process width limit is m, that is, the electrode slit with width m can only be made. However, if the two alignment pattern layers are staggered and the two electrode slit portions are overlapped in accordance with the present embodiment, the overlapped portion is a new width smaller electrode slit. In this way, the electric field strength at the electrode slit can be further enhanced, and the dark lines can be further reduced.

Figure 10:
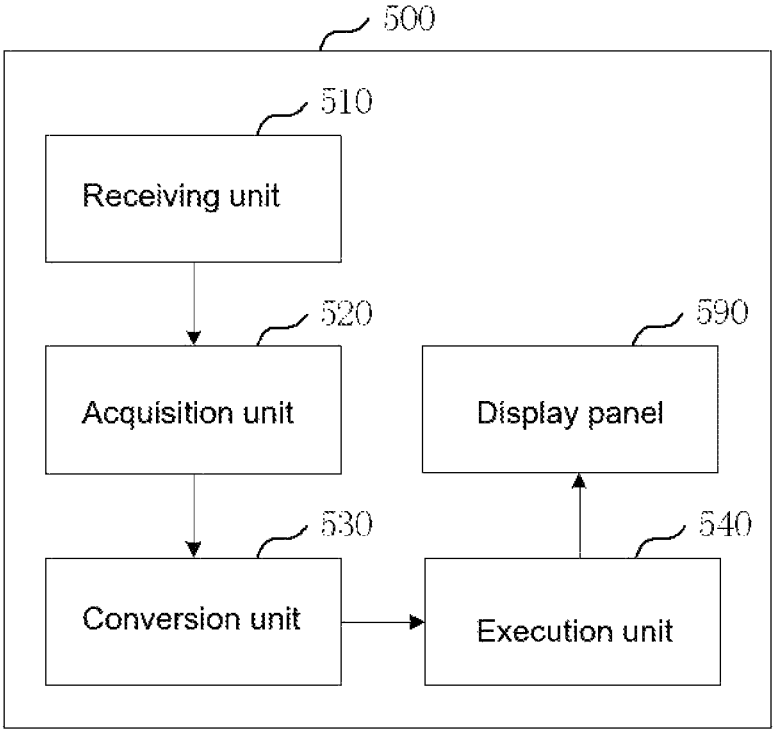
FIG. 10 is a schematic block diagram of a display device provided in embodiments 1 and 2 of the present application.

Referring to FIG. 10, FIG. 10 is a schematic block diagram of the display device 500 provided in the first and second embodiments of the present application. As shown in FIG. 10, the display device 500 includes: a display panel 590, a receiving unit 510, an acquisition unit 520, a conversion unit 530 and an execution unit 540. Wherein the receiving unit 510 is configured to receive the image data of the target picture; the acquisition unit 520 is configured to acquire a first voltage signal corresponding to the image data, that is, the voltage signal corresponding to the red, green, and blue sub-pixel units of the pixel unit is obtained as the first voltage signal; the conversion unit 530 is configured to convert the adjacent first voltage signal into a voltage distributed second voltage signal; and the execution unit 540 is configured to drive a pixel unit on the display panel 590 and respond to display the target picture according to the second voltage signal.

Specifically, after the receiving unit 510 receives the image data of the target screen, the acquisition unit 520 starts acquiring the first voltage signal corresponding to the image data. That is, the voltage signal corresponding to the red, green, and blue sub-pixel units of the pixel unit is obtained. In the first embodiment, the conversion unit 530 is used for converting a voltage signal group corresponding to a plurality of adjacent blue or green or red sub-pixel units into a voltage signal group of a voltage distributed, and the voltage distributed voltage signal group is the second voltage signal. In the first embodiment, the number of blue, green and red sub-pixel units for conversion into the second voltage signal is the same, through the phase distribution of the high ground voltage signal to achieve the front and side view brightness changes close to the purpose. Through the distribution of high and low voltage signals to meet the closing proportion of the brightness changes of the face and side view. In the second embodiment, the conversion unit 530 is used for converting a voltage signal group corresponding to a plurality of adjacent blue or green or red sub-pixel units into a voltage signal group of a voltage distributed. But the number of blue sub-pixel units for conversion to each second voltage signal is greater than the number of green or red sub-pixel units for conversion to each second voltage signal. Then the execution unit 540 driving the pixel unit and responding the pixel unit to display the target picture according to the second voltage signal. Because the human eye feels green and red is more sensitive. Since the number of blue sub-pixel units converted to each second voltage signal is larger than the number of green or red sub-pixel units for converting to the second voltage signal. So that the resolution of the converted green and red second voltage signals will be higher than the resolution of the blue second voltage signal, thereby avoiding the graininess of the picture.

Figure 11:
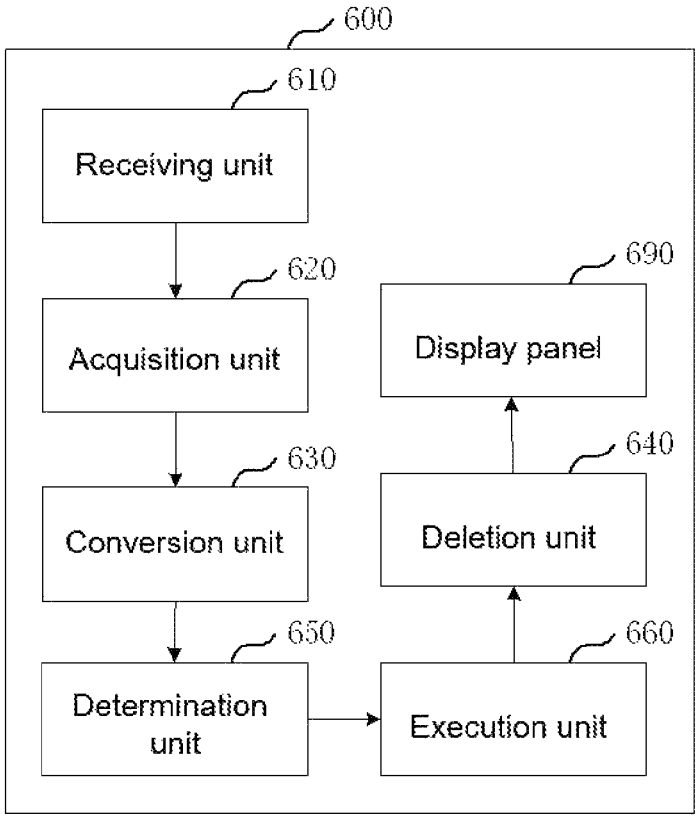
FIG. 11 is a schematic block diagram of a display device provided in the third embodiment of the present application.

Referring to FIG. 11, FIG. 11 is a schematic block diagram of a display device provided in the third embodiment of the present application. As shown in figure, the display device 600 includes: a display panel 690, a receiving unit 610, an acquisition unit 620, a conversion unit 630, a determination unit 650, a deletion unit 640 and an execution unit 660. Wherein the receiving unit 610 is configured to receive the image data of the target picture; the acquisition unit 620 is configured to acquire a first voltage signal corresponding to the image data, that is, the voltage signal corresponding to the red, green, and blue sub-pixel units of the pixel unit is obtained as the first voltage signal; the conversion unit 630 is configured to convert the adjacent first voltage signal into a voltage distributed second voltage signal; the determination unit 650 is configured to determine whether the second voltage signal exceeds a preset voltage threshold; the deletion unit 640 is used to delete the duration corresponding to the second voltage signal according to a preset deletion ratio if the second voltage signal exceeds the preset voltage threshold; and the execution unit 660 is configured to drive a pixel unit on the display panel 690 and respond to display the target picture according to the second voltage signal.

Specifically, after the receiving unit 610 receives the image data of the target screen, the acquisition unit 620 starts acquiring the first voltage signal corresponding to the image data. That is, the voltage signal corresponding to the red, green, and blue sub-pixel units of the pixel unit is obtained. And converts the adjacent first voltage signal into a second voltage signal having a voltage high and low phase distribution by the conversion unit 630. After the second voltage signal is converted, the determination unit 650 determines whether or not the second voltage signal exceeds the preset voltage threshold. If the preset voltage threshold is exceeded, the deletion unit 640 subtracts the duration of the second voltage signal from the preset deletion ratio. After the deletion is completed, the execution unit 660 drives the pixel unit and responds to the second voltage signal to display the target picture.

In some embodiments, the display panel 590 or 690 may be, for example, a twisted nematic liquid crystal display panel, a plane conversion type liquid crystal display panel a multi-quadrant vertical alignment LCD display panel, an OLED display panel, a QLED display panel, a curved display panel or other display panel.

In particular, by reducing the time of the second voltage signal exceeding the preset voltage threshold, the interference of the residual image left after the long display of the high luminance picture corresponding to the high voltage signal to the next frame is avoided, and the screen display clarity is improved.

In several embodiments provided herein, it is to be understood that the disclosed method is merely illustrative and may be embodied in other ways.

It should be noted that the steps in the embodiments of the present application can be sequentially adjusted, merged and deleted according to actual needs.

As described above, only the specific embodiments of the present application, but the scope of the present application is not limited thereto, it will be apparent to those skilled in the art that various modifications or substitutions may be readily apparent to those skilled in the art, and that such modifications or substitutions are intended to be within the scope of the present application. Accordingly, the scope of protection of the present application is subject to the scope of protection of the claims.

What is claimed is:

1. A display method used in a display device, comprising:

receiving an image data of a target picture;

acquiring first voltage signals corresponding to the image data;

converting adjacent ones of the first voltage signals into second voltage signals with high and low voltages interval distribution;

driving pixel units and responding the pixel units to display the target picture according to the second voltage signals;

wherein the converting adjacent ones of the first voltage signals into second voltage signals with high and low voltages interval distribution, comprises:

dividing the target picture into n blocks, wherein each of the n blocks comprises a plurality of cell blocks;

obtaining the second voltage signals of adjacent designated color sub-pixel units in each of the plurality of cell blocks according to an average signal of the first voltage signals of the adjacent designated color sub-pixel units and a lookup table, wherein the lookup table is obtained by a color judgement condition corresponding to another average signal of the first voltage signals of all designated color sub-pixel units in one of the n blocks including the plurality of cell blocks in a previous frame of picture, and the adjacent designated color sub-pixel units are adjacent blue sub-pixel units, adjacent red sub-pixel units, or adjacent green sub-pixel units of the pixel units.

2. The display method according to claim 1, wherein the acquiring first voltage signals corresponding to the image data comprises:

acquiring a voltage signal according to each of the red, green, and blue sub-pixel units of the pixel unit as the first voltage signal.

3. The display method according to claim 1, wherein before the step of driving pixel units and responding the pixel units to display the target picture according to the second voltage signals, further comprises:

determining whether the second voltage signal exceeds a preset voltage threshold;

deleting a duration corresponding to the second voltage signal according to a preset deletion ratio if the second voltage signal exceeds the preset voltage threshold.

4. The display method according to claim 1, wherein the pixel unit is etched with an alignment pattern.

5. The display method according to claim 4, wherein the alignment pattern comprises a first alignment pattern and a second alignment pattern, the first alignment pattern is stacked in parallel with the second alignment pattern and a preset distance is shifted.

6. The display method according to claim 1, wherein before the step of driving pixel units and responding the pixel units to display the target picture according to the second voltage signals, further comprises:

determining whether the second voltage signal exceeds a preset voltage threshold;

deleting a duration corresponding to the second voltage signal according to a preset deletion ratio if the second voltage signal exceeds the preset voltage threshold;

wherein the pixel unit is etched with a first alignment pattern and a second alignment pattern, the first alignment pattern being stacked in parallel with the second alignment pattern and shifting a preset distance.

7. The display method according to claim 1, wherein the acquiring first voltage signals corresponding to the image data comprises:

acquiring a voltage signal according to each of the red, green, and blue sub-pixel units of the pixel unit as the first voltage signal, wherein a surface of the pixel unit is etched with a first alignment pattern and a second alignment pattern, the first alignment pattern being stacked in parallel with the second alignment pattern and shifting a preset distance.

8. A display device comprising:

a display panel; and a screen driving panel, configured for:

receiving unit for receiving an image data of a target picture;

acquiring first voltage signals corresponding to the image data;

converting adjacent ones of the first voltage signals into second voltage signals with high and low voltages interval distribution; and driving pixel units on the display panel and responding the pixel units to display the target picture according to the second voltage signals;

wherein the converting adjacent ones of the first voltage signals into second voltage signals with high and low voltages interval distribution, comprises:

dividing the target picture into n blocks, wherein each of the n blocks comprises a plurality of cell blocks;

obtaining the second voltage signals of adjacent designated color sub-pixel units in each of the plurality of cell blocks according to an average signal of the first voltage signals of the adjacent designated color sub-pixel units and a lookup table, wherein the lookup table is obtained by a color judgement condition corresponding to another average signal of the first voltage signals of all designated color sub-pixel units in one of the n blocks including the plurality of cell blocks in a previous frame of picture, and the adjacent designated color sub-pixel units are adjacent blue sub-pixel units, adjacent red sub-pixel units, or adjacent green sub-pixel units of the pixel units.

9. The display device according to claim 8, wherein the acquiring first voltage signals corresponding to the image data comprises:

acquiring a voltage signal according to each of the red, green, and blue sub-pixel units of the pixel unit as the first voltage signal.

10. The display device according to claim 9, wherein the screen driving panel is further configured for:

determining whether the second voltage signal exceeds a preset voltage threshold before driving pixel units on the display panel and responding the pixel units to display the target picture according to the second voltage signals;

deleting a duration corresponding to the second voltage signal according to a preset deletion ratio if the second voltage signal exceeds the preset voltage threshold.

11. The display device according to claim 9, wherein the pixel unit is etched with an alignment pattern.

12. The display device according to claim 11, wherein the alignment pattern comprises a first alignment pattern and a second alignment pattern, the first alignment pattern is stacked in parallel with the second alignment pattern and a preset distance is shifted.

13. The display device according to claim 9, wherein the screen driving panel is further configured for:

determining whether the second voltage signal exceeds a preset voltage threshold before the execution unit driving a pixel unit and responding the pixel unit to display the target picture according to the second voltage signal;

deleting the duration corresponding to the second voltage signal according to a preset deletion ratio if the second voltage signal exceeds the preset voltage threshold; wherein, the pixel unit is etched with a first alignment pattern and a second alignment pattern, the first alignment pattern being stacked in parallel with the second alignment pattern and shifting a preset distance.

14. The display device according to claim 9, wherein the acquiring first voltage signals corresponding to the image data comprises:

acquiring a voltage signal according to each of the red, green, and blue sub-pixel units of the pixel unit as the first voltage signal, wherein a surface of the pixel unit is etched with a first alignment pattern and a second alignment pattern, the first alignment pattern being stacked in parallel with the second alignment pattern and shifting a preset distance.

* * * * *